United States Patent [19]

Eigenmann

[11] Patent Number: 4,925,335

[45] Date of Patent: May 15, 1990

[54] PREFABRICATED CONTINUOUS ROADMARKING TAPE HAVING OPTICAL AND ELECTROMAGNETIC FUNCTION

[76] Inventor: Ludwig Eigenmann, Via Dufour 3, CH 6900 Lugano, Switzerland

[21] Appl. No.: 273,521

[22] Filed: Nov. 21, 1988

Related U.S. Application Data

[63] Continuation-in-part of Ser. No. 106,288, Oct. 9, 1987, abandoned.

[51] Int. Cl.[5] ..... E01F 9/06

[52] U.S. Cl. ..... 404/12; 404/14

[58] Field of Search ..... 404/12, 13, 14

[56] References Cited

U.S. PATENT DOCUMENTS

| | | | |
|---|---|---|---|
| 2,849,701 | 8/1958 | Clark | 404/9 X |
| 3,836,275 | 9/1974 | Finch | 404/13 |
| 4,050,834 | 9/1977 | Lee | 404/16 |
| 4,072,403 | 2/1978 | Eigenmann | 350/105 |
| 4,668,120 | 5/1987 | Roberts | 404/12 |
| 4,685,824 | 8/1987 | Eigenmann | 404/9 |

FOREIGN PATENT DOCUMENTS

| | | |
|---|---|---|
| 233797 | 9/1980 | Argentina . |
| 539631 | 5/1980 | Australia . |
| 883208 | 5/1980 | Belgium . |
| 8003002 | 5/1980 | Brazil . |
| 1149491 | 7/1983 | Canada . |
| 0100524 | 6/1984 | European Pat. Off. . |
| 2400290 | 7/1974 | Fed. Rep. of Germany . |
| 8010745 | 5/1980 | France . |
| 491399 | 2/1981 | Spain . |
| 8003558-7 | 11/1980 | Sweden . |
| 641585 | 5/1980 | Switzerland . |
| 2050769 | 1/1981 | United Kingdom . |

*Primary Examiner*—William P. Neuder

*Attorney, Agent, or Firm*—David H. Semmes

[57] ABSTRACT

A prefabricated continuous multilayer road-marking tape is described, which includes retroreflecting optical components, light emitting diodes (LEDs), solar cells, storage batteries, and reflectors and transmitters of electromagnetic waves. There are given examples of the use of the reflectors in order to control the speed of a vehicle which travels far from the tape, and examples of the use of EPROMs (erasable programmable read only memory) where messages are recorded, with the purpose of giving information about the conditions of the road, the presence of ice or of traffic jams, and so on, said messages being transmitted by a radio transmitter.

7 Claims, 6 Drawing Sheets

PREFABRICATED CONTINUOUS ROADMARKING TAPE HAVING OPTICAL AND ELECTROMAGNETIC FUNCTION

CROSS-REFERENCE TO RELATED APPLICATIONS

This application is a continuation-in-part of Applicant's application Ser. No. 106,288 filed Oct. 9, 1987, now abandoned.

DESCRIPTION

The continuous horizontal road-marking tape technology achieves by the present application a further important improvement. Applicant, starting more than twenty years ago, has developed layered road-marking tapes, and later on the use of electric energy and of electromagnetic energy in the technique of road-marking has been developed.

In this respect, applicant's following foreign Patents may be cited: No. 641.585 in Switzerland, No. 883.208 in Belgium, No. 491.399 in Spain, No. 1,149,491 in Canada No. 80-10745 in France, No. 1.050.769 in the UK, No. 539.631 in Australia, No. 80 03002 in Brazil, No. 233.797 in Argentina, No. 80 03558-7 in Sweden.

As a matter of fact, the denomination "road marking tape" is today very vague, because the information supplied by the tape includes not only optical irradiations, but also electromagnetic irradiations, that are performed.

As we are referring to horizontal road-marking tapes, of course the road marking effect is the more important function and, consequently, the tape has to include retroreflective elements, light emitting diodes (LEDs), solar cells and storage batteries, and the tape has to be in a position to exploit only that solar energy which is incident upon the tape.

On the other hand, we have not yet reached a high level of safety if we don't exploit the potential contribution of electromagnetic energy, as transmitted by antennas placed onto or inside the tape.

The following are specific examples where the contribution of electromagnetic energy is nearly vital:

(1) Dangerous locations: One cannot be always aware of a dangerous location in the road which requires a reduction in vehicle speed. In such case, the warning impulse has to come from the tape, e.g. from a gigaherz reflector dipped in a layer of adhesive, and positioned upon the lower layers of the tape. Said warning impulse originates the activation of a comparator placed on the vehicle and, consequently, the activation of an optical or an acoustical indicator within the vehicle.

(2) Presence of ice: This hazard is very important, since the presence of ice cannot be seen. A negative temperature control (NTC) activates an EPROM (erasable programmable read only memory) chip and, consequently, a megaherz transmitter, which is positioned, together with its antenna, upon one of the layers of the tape. A message for reduction of speed is then emitted.

(3) Traffic jam: This hazard is becoming more and more frequent today, with drivers loosing their tempers. In this case, as it will be explained in detail later on, the drivers intervene as the vehicle presses an emergency microswitch placed under the tape. The EPROM, the megaherz transmitter and its antenna are consequently activated, but at the same time also an uni-directional light emitting tape is activated for discharging the jam.

From the above examples, it appears obvious that both types of irradiations are useful and necessary, i.e. optical irradiation and electromagnetic irradiation.

Before describing electromagnetic irradiation, let us detail the structure of the tape which has assured the best results.

DESCRIPTION OF THE DRAWINGS

FIG. 1 is an exploded, fragmentary schematic view showing in side elevation and top plan the several layers of a tape constructed according to the present invention. More in detail:

Reference is made to FIG. 1, with the remark that not all layers shown have to be necessarily present in the tape; a cross section and a corresponding plan view are shown.

The upper layer 2 (FIGS. 1A and 1B) is a wear resistant film made of polyurethane resin, which material for many years has secured the best results. Upper layer 2 is pigmented, for example with a pigment containing titanium dioxide, in order to ensure the best visibility by day; retroreflecting elements, for example glass beads or those which are the object of Applicant's U.S. Pat. No. 4,072,403, are applied upon it; at 16 there is represented one of the transparent protrusions in which there are placed solar cells, storage batteries, light emitting diodes (LEDs) and, as an alternative arrangement, a megaherz transmitter.

See later on, with reference to FIG. 9, a more detailed description of said transparent protrusions and of their contents.

Figure 1A:
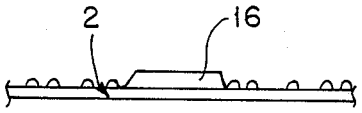
FIGS. 1A and 1B show the upper wear resistant layer having optical function.
Figure 1B:
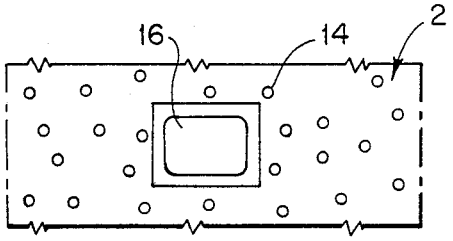
Figure 1C:
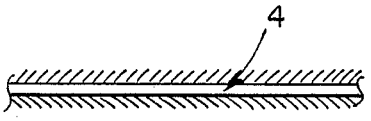
FIGS. 1C and 1D show an intermediate layer, which provides the mechanical properties of the tape.
Figure 1D:
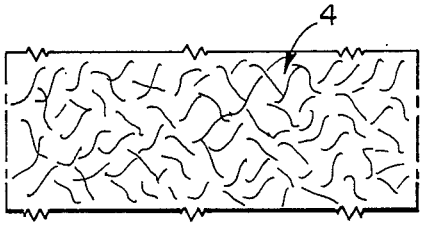

The following intermediate layer 4, of FIGS. 1C and 1D, consists of a non-woven fabric, strongly impregnated with a polyurethane prepolymer, which provides the mechanical properties of the tape.

The third layer 6, of FIGS. 1E and 1F, includes reflectors 18, which are dipped in adhesive, and which will be described in detail later on.

The fourth layer 8, of FIGS. 1G and 1H, consists of the circuits connecting the electrical and the electromagnetic components, which circuits may be concretized by polymerized conductive dispersions, similar to those which will be described with reference to FIGS. 1L and 1M, concerning the EMI shielding.

Figure 1E:
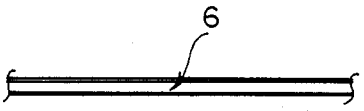
FIGS. 1E and 1F show a layer which includes electromagnetic reflectors.
Figure 1F:
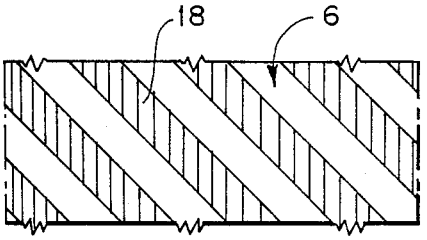
Figure 1G:
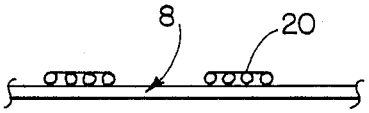
FIGS. 1G and 1H show a layer which includes the circuits which connect the electric and the electromagnetic components.
Figure 1H:
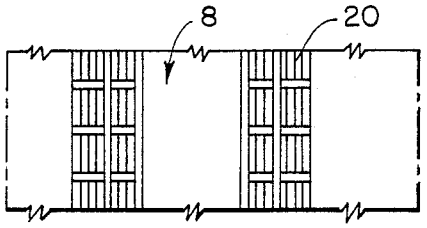
Figure 1L:
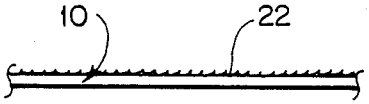
FIGS. 1L and 1M show an EMI (electromagnetic interference) shielding layer.
Figure 1M:
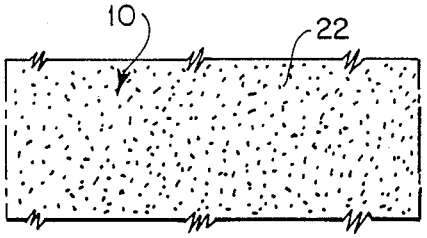
Figure 1N:
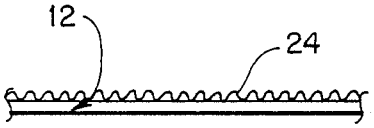
FIGS. 1N and 1P show a layer consisting of a strong extensible web.
Figure 1P:
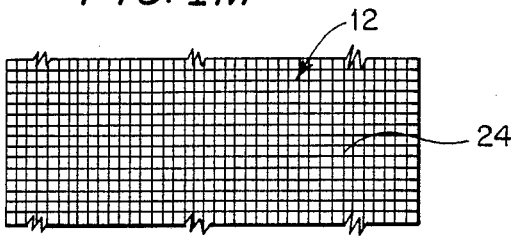

The fifth layer 10, of FIGS. 1L and 1M, is the EMI (electromagnetic interference) shielding layer, which has the function of protecting the electromagnetic elements from disturbing interferences coming from the ground. Layer 10 consists of a dispersion of conductive particles or of a metallization, schematically shown at 22. Good results have been obtained by using high percentage nickel dispersions in an acrylic prepolymer, like the nickel dispersions manufactured by the firm Metalgalvano Sozzi of Rovello Porro (Italy), or the acrylic coating 3M110 manufactured by Minnesota Mining & Manufacturing Company.

Since the aforesaid tape has a certain fixed cost, even if not very high, it is necessary to have the capability of removing the tape to another location. To this end, the sixth layer 12, of FIGS. 1N and 1P, may consist of a strong extensible web, strongly impregnated by an adhesive, which has a good adhesion to the road surface, but at the same time allows the removal of the tape without damage, said layer being illustrated in plan view by 24. The thickness of the adhesive which ensures a good adhesion of the tape to the road surface may be of about 0.4 mm.

Figure 2:
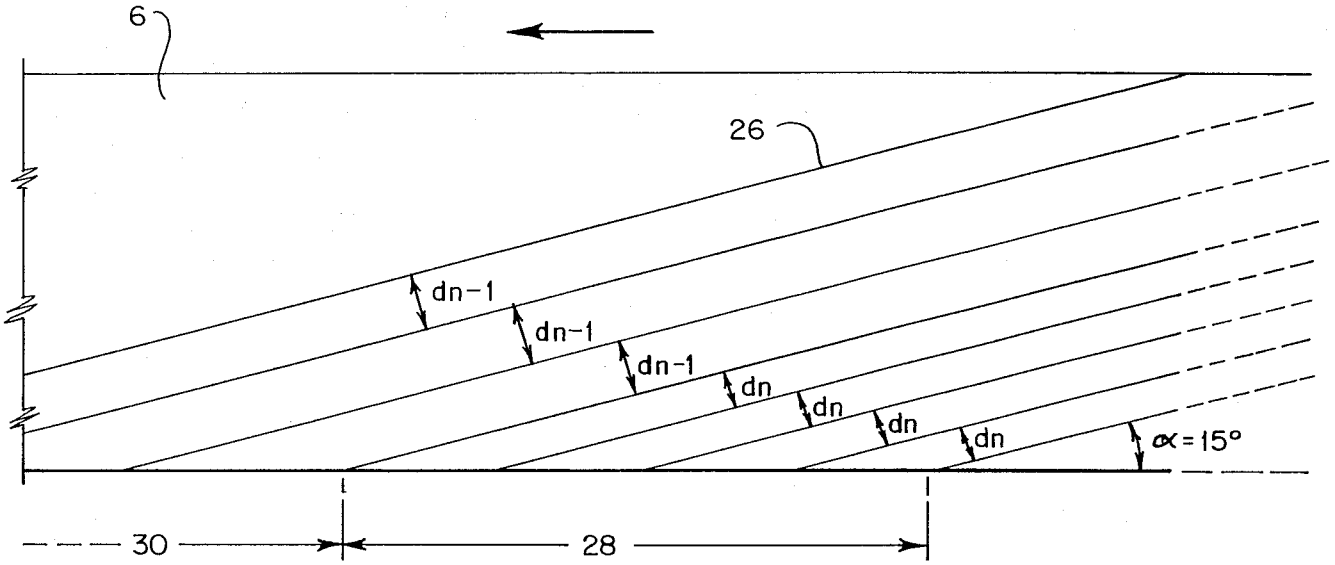
FIG. 2 is a fragmentary top plan view of the third tape layer 6 of FIGS. 1E and 1F which includes various groups of equidistant metallic stripes 26 adhering to the tape.

Returning to the functions of the tape, reflector 6, shown in FIGS. 1E, 1F and 2, which reflects back electromagnetic energy irradiated by a transmitter placed on the vehicle, operating in the field of frequency of the gigaherz, is fundamental for the control of the vehicle speed.

Gigaherz reflector 6 is concretized by multiple conductive stripes 26 dipped in adhesive, illustrated in FIG. 2, which stripes 26 are positioned at an angular direction—usually 15°—related to the direction of vehicle traffic. This angular feature assures good reception of the reflected waves at the side of the tape, within a sufficiently wide lateral lane.

As shown in FIG. 2, reflector 6 consists of several groups of equidistant metallic stripes 26 adhering to the tape. For example, metal stripe foils 26 of 1 mm width are illustrated with each group being characterized by a different distance between the stripes 26: e.g., in FIG. 2 there are shown two groups, 28 and 30, wherein the adjacent metal foils 26 have a different spaced apart distance.

Gigaherz reflector 6 shows a diffuse reflection behavior in elevation, and since the position of the vehicle on the road may vary within a certain space of several meters perpendicularly to the axial direction of the traffic, the reflection maxima should be as close as possible within the reflection diagram.

Good results have been obtained by choosing, for a space at the side of the tape of 0 to 4 meters, four groups of stripes, with a first group having a spaced apart distance of 2 cm between each stripe, of 1,8 cm spaced apart in a second group, of 1,6 cm spaced apart in a third group, and of 1,4 cm spaced apart in a fourth group. More than five stripes 26 have been used in every group, with the length of each stripe being at least 50 cm, but usually much more.

Figure 3:
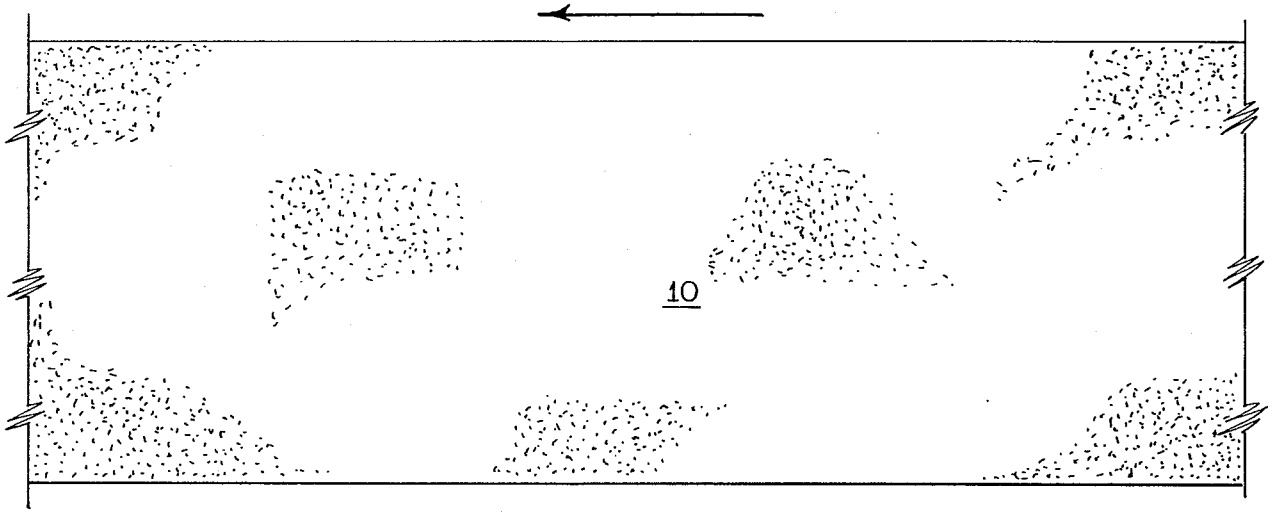
FIG. 3 is a fragmentary top plan view of the shielding layer 10 of FIGS. 1L and 1M.

In FIG. 3 there is shown the shielding layer 10 of FIGS. 1L and 1M, concretized as described, which shielding is somewhat wider than the group of the reflectors 26, in order to obtain the best possible shielding effect.

Figure 4:
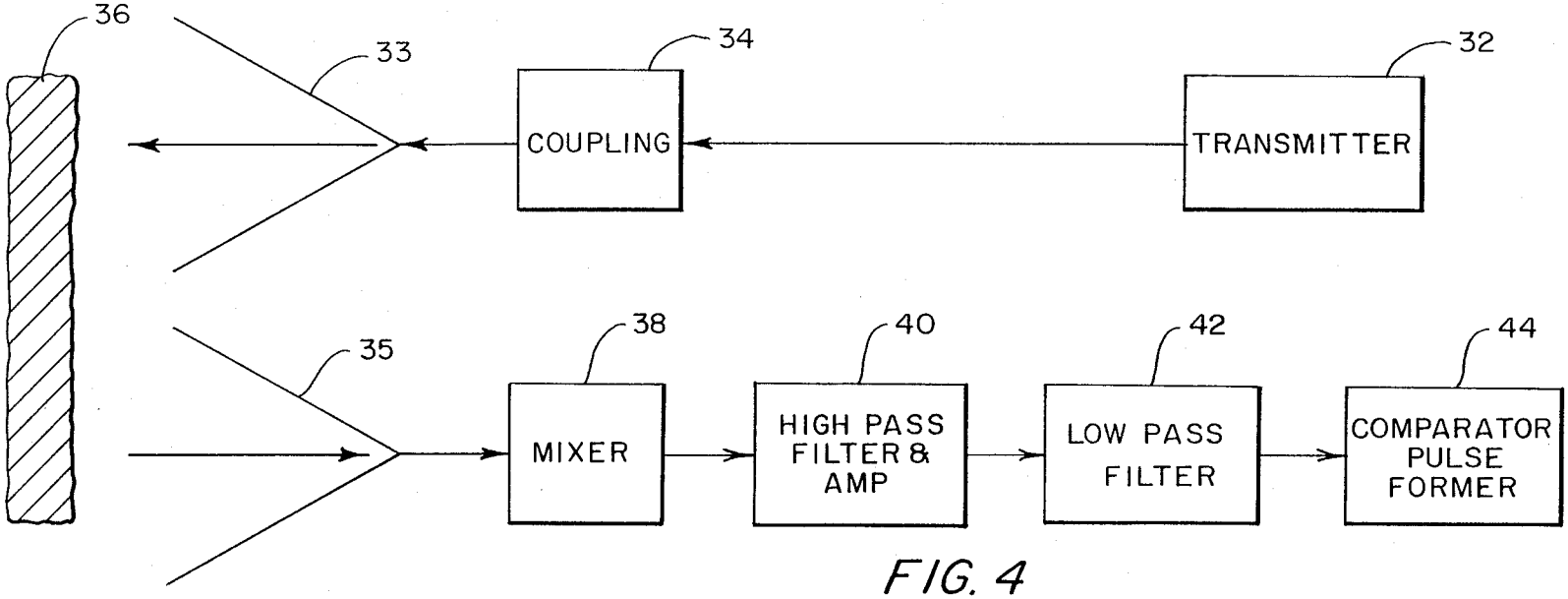
FIG. 4 is a schematic showing a suggested gigaherz transmitter and receiver for activating speed control within the vehicle.

In FIG. 4, there are schematically shown the techniques for transmission and reception. These occur at a frequency within the field of the gigaherz, for example at 24 Ghz.

Transmitter 32 on the vehicle consists of a frequency stability oscillator, for example the AEG Telefunken "Warning device", which has an output power of 0.5 W; it is connected by means of coupling 34 to horn antenna 33, which may have, advantageously, an angle of 45° with respect to the road surface, and irradiates towards reflector 36, or 26 with reference to FIG. 2.

The energy returning from reflector 36 is received by another horn antenna 35, also placed on the vehicle, and is conducted to mixer 38, from which a frequency $f_D$ comes out, which is the difference between the frequency emitted by antenna 33 and the one received by antenna 35. In fact, as the reflector 36 is swept at a certain speed, the transmission and reception frequencies will not be the same, because of the Doppler effect.

The signal, from mixer 38 is conducted to high-pass filter and 80 dB amplifier 40, then to low-pass filter 42, and finally to a comparator and pulse former 44.

There are now two methods for activating the indicator on the vehicle. The first method is based on the impulses originating from metal stripes 26, upon sweeping of the transmitted waves on the tape, i.e. the waves frequency, and only refers to the vehicle speed. The impulses build an impulse train, such that the threshold of the comparator 44 is overpassed and an indicator is activated.

The second method is more sure. Comparator 44 of FIG. 4 includes a generator of a tuning note, fitted for a selected speed, which provides impulses of a certain form and frequency. When the reflected waves and the impulses provided for a selected speed are overlapping, an indicator on the vehicle is activated. This described technology is very well known.

The control of vehicle speed in dangerous locations is very important, and you can predict a kind of a "black box" for these dangerous locations in order to compel vehicle drivers to reduce speed. The above described technology may be used also for warning the vehicle driver of the presence of bends, cross-roads, and the like.

As mentioned, the composite road marking tape which is the object of the present invention includes a small megaherz radio transmitter 52, which will be described later in detail with reference to FIG. 8. Said transmitter has the function to give electromagnetic impulses to the car in order to reach specific goals; it irradiates messages recorded in EPROM (erasable programmable read only memory) chip; it has a very low consumption of energy, for example 8 mW, and is fed by small storage batteries which in their turn are fed by solar cells, which may be placed on the tape in the form of those transparent protrusions 16 of FIGS. 1A and 1B, as it will be described with reference to FIG. 9; the transmitter 52 too may be placed in said transparent protrusions, or in another lower layer of the tape, dipped in adhesive.

Figure 5:
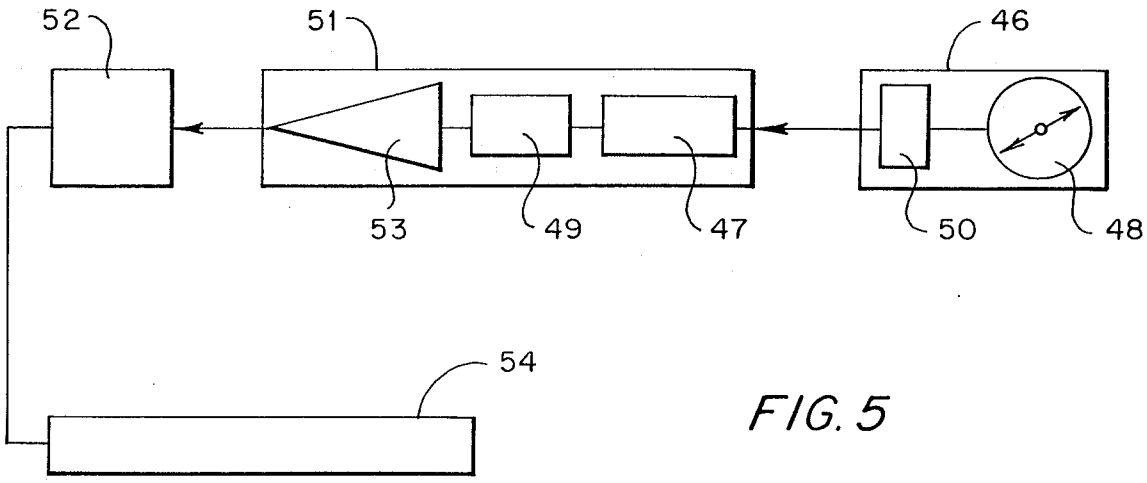
FIG. 5 is a schematic of a mode utilizing a negative temperature control (NTC) device 46 for warning the vehicle driver as to the presence of ice on the roadway.

In FIG. 5 a mode is shown of utilization of transmitter 52 with the purpose of warning the vehicle driver as to the presence of ice. It utilizes a Negative Temperature Control—NTC—46, consisting of sensor 48 and calibration device 50; the EPROM 51 consists of an integrator 47, memory 49, and amplifier 53; and transmitter 52 has a dipole antenna 54. When the temperature falls below a preset limit, these devices transmit a recorded message.

Figure 6:
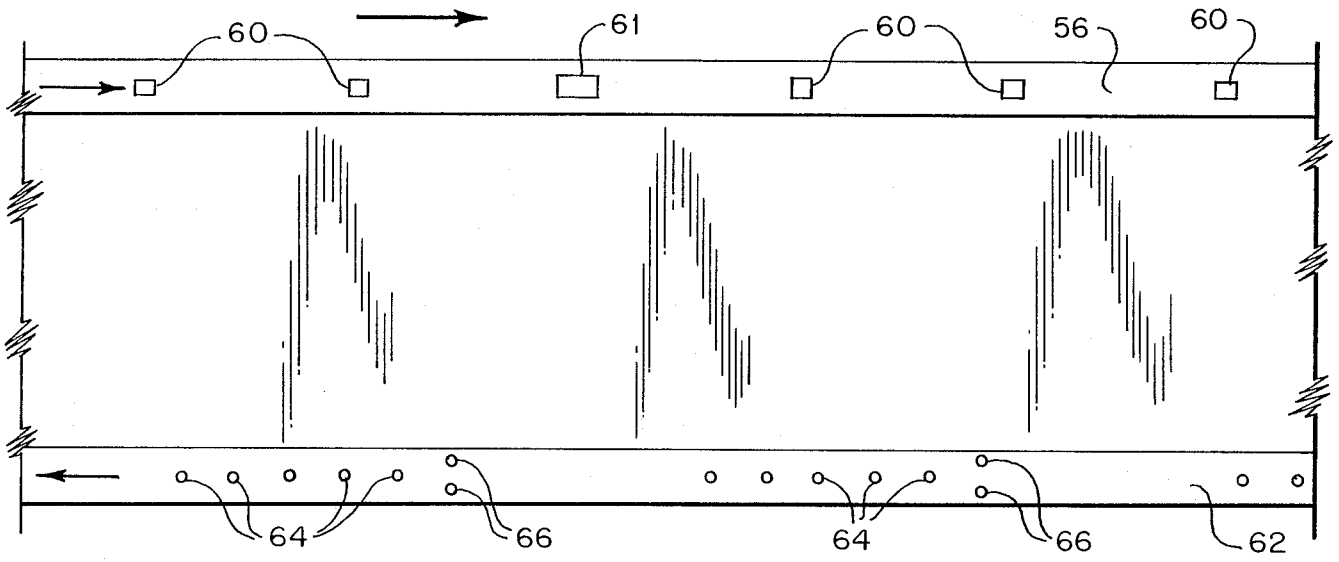
FIG. 6 is a fragmentary top plan showing the employment of parallel signaling tapes 56,62 for signalling a traffic jam and activating directional signals so as to direct vehicles away from the traffic jam.

Another very important hazard is the traffic jam. In FIG. 6 there is shown how a traffic jam hazard may be signaled, and how indicators may be activated in order to discharge the traffic jam. There are illustrated two signalling tapes 56, 62, placed in parallel, and connected by means of an electric cable (not illustrated). Tape 56 is a conventional marking tape, and tape 62 is an emergency tape. On tape 56 there are shown the transparent protrusions 60, in which LEDs, solar cells and storage batteries are placed, as within those transparent protrusions 16 of FIGS. 1A and 1B. There are provided also, at predetermined locations, compressible portions 61, in which a microswitch is placed. Concerning such compressible tape, see applicant's U.S. Pat. No. 4,685,824 and European Pat. No. 0100524.

In case of a traffic jam, a vehicle driver who takes the initiative, or a traffic policeman, activates the microswitch by driving his car upon compressible portion 61. This activates an alarm system, like the one which has been illustrated in FIG. 6 and aforedescribed for signalling the presence of ice. From one side, tape 56 is lighted, on the other side, tape 62 is activated. On tape 62 there may be provided transverse aligned pulsing lights 66, of red color, and longitudinally aligned pulsing lights 64, of green color. Lights 64 guide the traffic away in a direction which is opposite to the normal direction of the traffic, e.g., towards an exit. The pulsing of the lights 64 may be very rapid. Thus, the traffic in the opposite direction, discharging the jam, may proceed on an overtaking lane or on an emergency lane, as possible in the particular situation.

At the same time, a further entry of vehicles in the traffic jam portion of the highway must be prevented, and to this purpose at the beginning of said traffic jam portion a red traffic light (not illustrated) will be lighted. Furthermore, a couple or more sensors (not illustrated) may be placed at the beginning of the concerned traffic jam portion, so that if a car enters and travels in the temporarily forbidden direction, notwithstanding the red traffic lights, its plate will be identified by a camera.

The circuits which are required in order to concretize such tapes, red traffic lights, sensors, pertain to known techniques.

Many other hazards may be taken into consideration for which analogous information systems may be employed, for example, the hazard of fog.

The traffic jam road marking tape may also be useful for guiding traffic in the direction, for example, of the city center, or in other directions.

Figure 7:
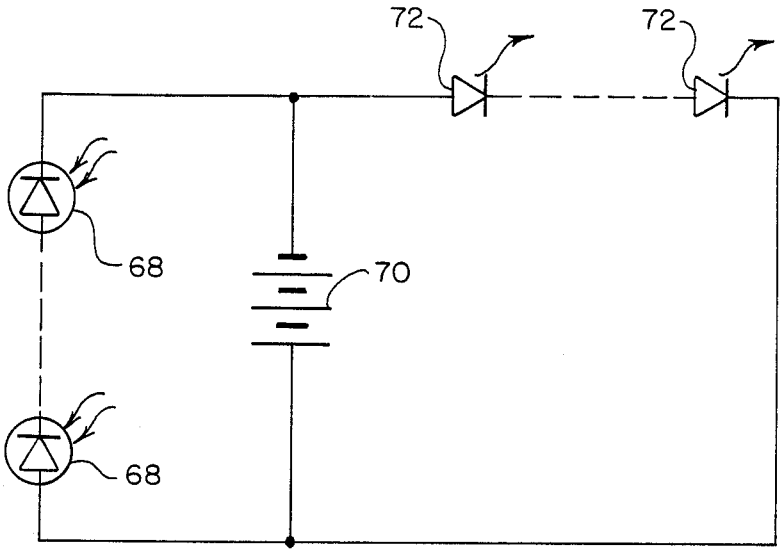
FIG. 7 is the schematic electrical diagram of the circuitry connecting solar cells 68, storage batteries 70 and LEDs 72.

In the schematic electrical diagram of FIG. 7, the solar cells 68 feed the storage battery 70, which at its turn feeds the LEDs 72.

The battery 70 consists, in the reality, of a plurality of small batteries connected in series-parallel, as it will be necessary for feeding the connected LEDs, or the megaherz transmitter. Good results have been obtained by using the solar cells manufactured by the firm Siemens (Germany), the small storage batteries manufactured by the firm Warta (Germany), the LEDs manufactured by the firm Oshino (Japan).

Figure 8:
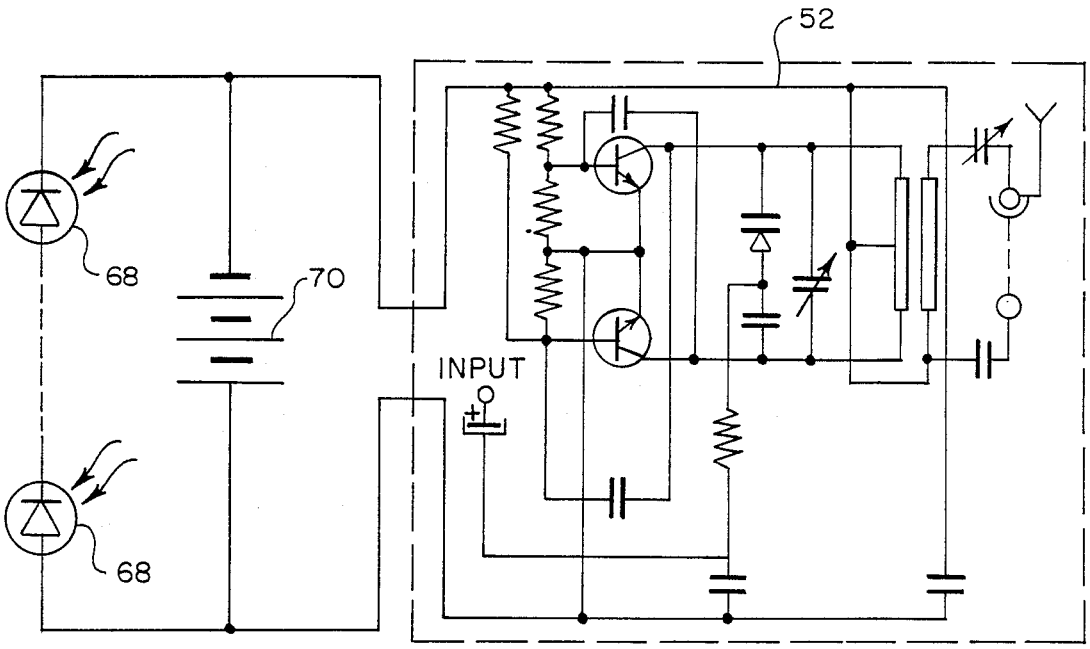
FIG. 8 is the schematic electrical diagram of the circuitry connecting solar cells 68, storage batteries 70 and an example of megaherz transmitter 52.
Figure 9A:
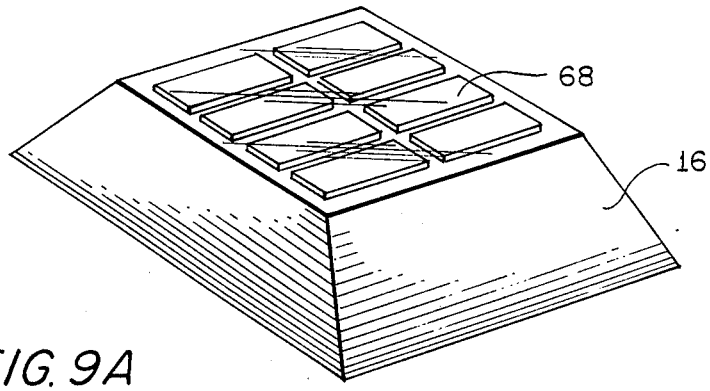
FIG. 9, A, B, C, D, is an enlarged view of the transparent protrusions 16 of FIGS. 1A and 1B, showing the arrangement of solar cells 68 and of storage batteries 70.
Figure 9B:
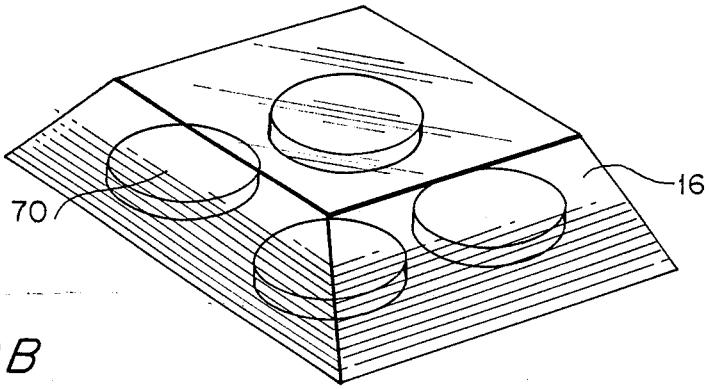
Figure 9C:
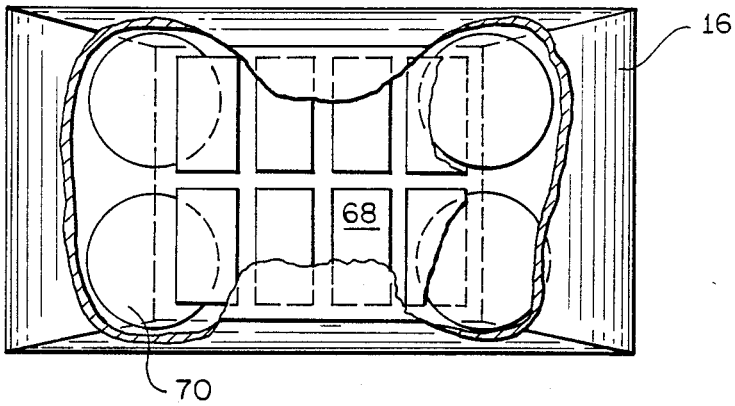
Figure 9D:
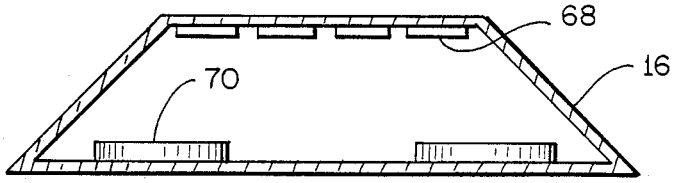

In the schematic electrical diagram of FIG. 8, there is shown how the solar cells 68 and the storage battery (or batteries) 70 feed the megaherz transmitter 52, of which a schematic diagram is also shown.

The megaherz transmitter of which the schematic diagram is shown in FIG. 8 is the type R68 manufactured by the firm G.B.C. of Cinisello Balsamo (Italy); it may be settled to operate at a frequency between 80 and 120 megaherz, and has such dimensions that it is possible to place it inside of the transparent protrusions 16 (see below); the feeding voltage may be of 5 V; the antenna may consist simply of a metallic cable having the length of ¼ of the settled wave length.

Of course every type of transmitter having similar performances and dimensions may be employed.

Instead of inside the transparent protrusions 16, the megaherz transmitter may be placed inside of the tape, onto one of the layers which have been described, dipped in adhesive.

In FIG. 9 there is shown an enlarged view of the transparent protrusions 16 of FIGS. 1A and 1B, in perspective view (FIGS. 9A and 9B), top plan view (FIG. 9C), cross section view (FIG. 9D), where the arrangement of solar cells 68 and of storage batteries 70 is shown. The figures are self-explanatory.

The protrusions 16 are made advantageously of transparent polycarbonate, and their dimensions may be, for example, of 6×3 cm in plan, with an height of 2.5 cm; the thickness may be of 5 mm, which is sufficient to withstand the weight of the heavy traffic.

As still said, in the transparent protrusions of such dimensions may be placed also the above described megaherz transmitter.

Inside of the transparent protrusions may also be placed the LEDs, and it has to be remarked that all protrusions may contain LEDs and/or solar cells, in order to maximize the marking efficiency and the energy balance, while the quantity of storage batteries may be smaller.

I claim:

1. Continuous prefabricated multilayer road-marking tape secured on the road surface, to be exploited by the incoming traffic, comprising:

(a) an upper wear resistant face layer, having transparent protrusions, and further including:
  (i) retroreflecting components;
  (ii) solar cells;
  (iii) storage batteries of small size;
  (iv) light emitting diodes (LEDs); and
  (v) transmitting units of low energy absorption operating in the field of frequency of the megaherz;

(b) an impregnated non-woven middle positioned layer;

(c) an antenna consisting of conductive wires connected to said transmitting units;

(d) an EMI (electromagnetic interferences) shielding on a low face of the tape as a protection against the electromagnetic perturbations coming from the road surface;

(e) a layer consisting of a strong extensible web which allows the removal of the tape from the road surface; and (f) electrical circuits connecting said solar cells, storage batteries, light emitting diodes, transmitting units and antenna.

2. Continuous prefabricated multilayer road-marking tape secured on the road surface, as in claim 1, which transmits electromagnetic waves from conductive stripes adhering to a low layer of the tape, forming a reflector operating at a frequency in the field of the gigaherz, and protected by an EMI (electromagnetic interferences) shielding against the perturbations from the road surface.

3. Continuous prefabricated multilayer road-marking tape secured on the road surface, as in claim 1, which transmits electromagnetic waves from an antenna operating in the field of frequency of the megaherz connected with a transmitter positioned on the tape, and protected by an EMI (electromagnetic interferences) shielding against the perturbation from the road surface.

4. Continuous prefabricated multilayer road-marking tape secured on the road surface, as in claim 2, where the multiple conductive stripes dipped in adhesive are specifically positioned at an angular direction in respect to the traffic direction.

5. Continuous prefabricated multilayer road-marking tape secured on the road surface, as in claim 3, which emits, by means of the megaherz transmitter, messages recorded in EPROM (erasable programmable only memory) chip, to be exploited by an incoming car.

6. Continuous prefabricated multilayer road-marking tape secured on the road surface, as in claim 5, said messages recorded in EPROM indicate too low temperature of the road surface.

7. Continuous prefabricated multilayer road-marking tape secured on the road surface including:

(a) a microswitch positioned in a compressible portion of the tape and activable by compression of the tape;

(b) an EPROM connected with said microswitch and a megaherz transmitter so as to transmit a message concerning a traffic jam;

(c) a series of directional light emitting diodes (LEDs) activated by said microswitch as to direct the vehicular traffic away from the jam.

* * * * *